US010045576B2

(12) United States Patent
Kim

(10) Patent No.: US 10,045,576 B2
(45) Date of Patent: Aug. 14, 2018

(54) GARMENT POCKET FOR MOBILE ELECTRIC DEVICE

(71) Applicant: Yong Chong Kim, Los Angeles, CA (US)

(72) Inventor: Yong Chong Kim, Los Angeles, CA (US)

( * ) Notice: Subject to any disclaimer, the term of this patent is extended or adjusted under 35 U.S.C. 154(b) by 399 days.

(21) Appl. No.: 14/964,224

(22) Filed: Dec. 9, 2015

(65) Prior Publication Data

US 2016/0235146 A1 Aug. 18, 2016

Related U.S. Application Data

(63) Continuation-in-part of application No. 14/585,757, filed on Dec. 30, 2014, now Pat. No. 9,247,776.

(51) Int. Cl.
*A41D 27/20* (2006.01)

(52) U.S. Cl.
CPC ..... *A41D 27/205* (2013.01); *A41D 27/20* (2013.01); *A41D 27/201* (2013.01)

(58) Field of Classification Search
CPC ..... A41D 1/02; A41D 13/0012; A41D 27/20; A41D 13/02; A41D 1/06; A41D 3/00; A41F 5/00
See application file for complete search history.

(56) References Cited

U.S. PATENT DOCUMENTS 4,599,750 A * 7/1986 Rahaman ..... A41D 27/20 2/227
6,216,280 B1 * 4/2001 Rabe ..... A41D 1/00 2/247
6,311,335 B1 * 11/2001 Uchida ..... A41D 27/205 2/227
7,636,949 B1 * 12/2009 Shooshan ..... A41D 13/0012 2/48
9,241,515 B2 1/2016 Kim
9,247,776 B1 2/2016 Kim
9,775,426 B1 * 10/2017 Amacker ..... A45F 3/14

* cited by examiner

*Primary Examiner* — Tejash Patel
(74) *Attorney, Agent, or Firm* — Heedong Chae; Lucern, PC

(57) ABSTRACT

A pocket for a garment for receiving a mobile electronic device therein includes a lower portion, fixedly attached to the garment, and an upper portion, fixedly attached to the garment. In addition, the lower and upper portions form the pocket for receiving the mobile electronic device. Furthermore, a depth adjusting means is formed on the lower portion and the garment for vertically adjusting a pocket space and a width adjusting means is formed on the upper portion and the garment for horizontally adjusting the pocket space.

20 Claims, 13 Drawing Sheets

GARMENT POCKET FOR MOBILE ELECTRIC DEVICE

CROSS-REFERENCE TO RELATED APPLICATIONS

This application is a Continuation-in-part application of and claims priority to U.S. non-provisional application Ser. No. 14/585,757 filed Dec. 30, 2014, the disclosure of which is incorporated herein in its entirety by reference thereto.

FIELD OF THE INVENTION

The present invention relates to a pocket for a garment for carrying personal items such as a mobile phone. The present invention further includes a detachable pocket for a garment which is attached to a waist of the garment.

SUMMARY OF THE INVENTION

The present invention provides a pocket for a garment for carrying personal items such as a mobile phone, smart phone or cell phone. A smart phone is generally getting bigger and bigger and there has been a need for a pocket to carry such a big smart phone.

The object of the present invention is to provide a pocket for a garment for receiving a mobile electronic device therein, which includes a lower portion, fixedly attached to the garment; and an upper portion, fixedly attached to the garment; wherein the lower and upper portions form the pocket for receiving the mobile electronic device, wherein a depth adjusting means is formed on the lower portion and the garment for vertically adjusting a pocket space, wherein a width adjusting means is formed on the upper portion and the garment for horizontally adjusting the pocket space.

Another object of the present invention is to provide a garment having a detachable pocket, which includes an attachment means for detachably attaching the detachable pocket to the garment; and a rotating axis portion wherein the detachable pocket is constructed to rotate with respect to the rotating axis portion.

Still another object of the present invention is to provide a garment for a pocket, which includes a first pocket, fixedly formed on inner of the garment at a predetermined location, having a first opening wherein the first pocket is accessible through the first opening; a first closure means to open or close the first opening, a second pocket, fixedly attached to the garment at a predetermined location, having a second opening wherein the second pocket is accessible through the second opening; a second closure means to open or close the second opening; a third pocket, fixedly attached to the garment at a predetermined location, having a vertical opening formed in a vicinity of the pocket and a third closure means to open or close the third opening.

The advantages of the present invention are: (1) the present invention provides a pocket for a garment to carry a large item such as a mobile phone or smart phone; (2) the present invention is easy to manufacture and convenient to use; (3) the structure of the present invention is pleasing in appearance and functionally superior; (4) the pocket of the present invention is convenient to receive and store a mobile phone therein; and (5) the size of the pocket can vary to receive different sizes of a mobile phone.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 7(*b*) shows a rear view of the detachable pocket having formed an attachment means;

FIG. 8(*b*) shows a rear view of the detachable pocket having a thickness adjusting means according to another embodiment of the present invention;

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may foe expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

The present invention relates to a pocket 100 for a garment 80 for carrying having personal items such as a mobile phone. The present invention further includes a garment having a detachable pocket 210 which is attached to a waist of the garment 200.

While the invention has been shown and described with reference to different embodiments thereof, it will be appreciated by those skilled in the art that variations in form, detail, compositions and operation may be made without departing from the spirit and scope of the invention as defined by the accompanying claims.

Figure 1:
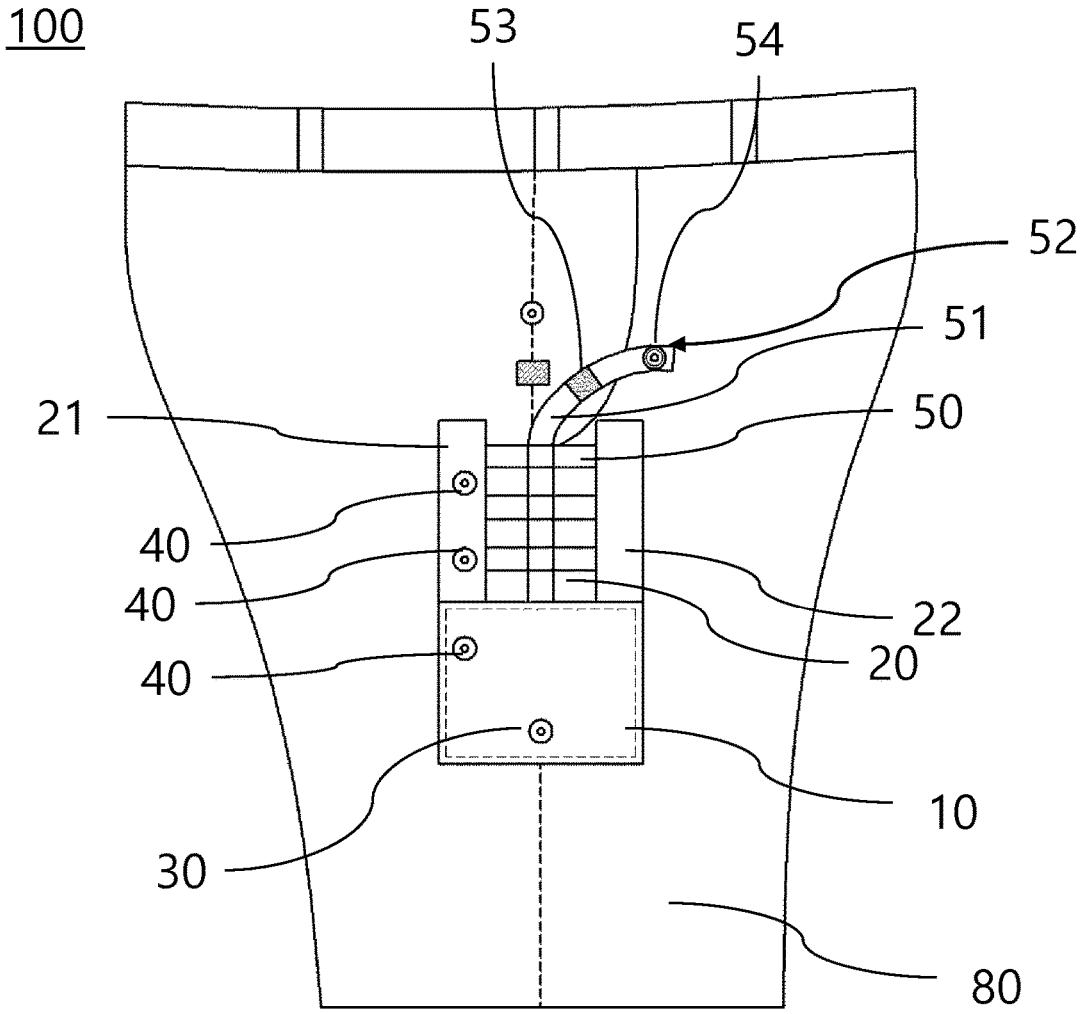
FIG. 1 shows a front view of a pocket for a garment according to one embodiment of the present invention.
Figure 2:
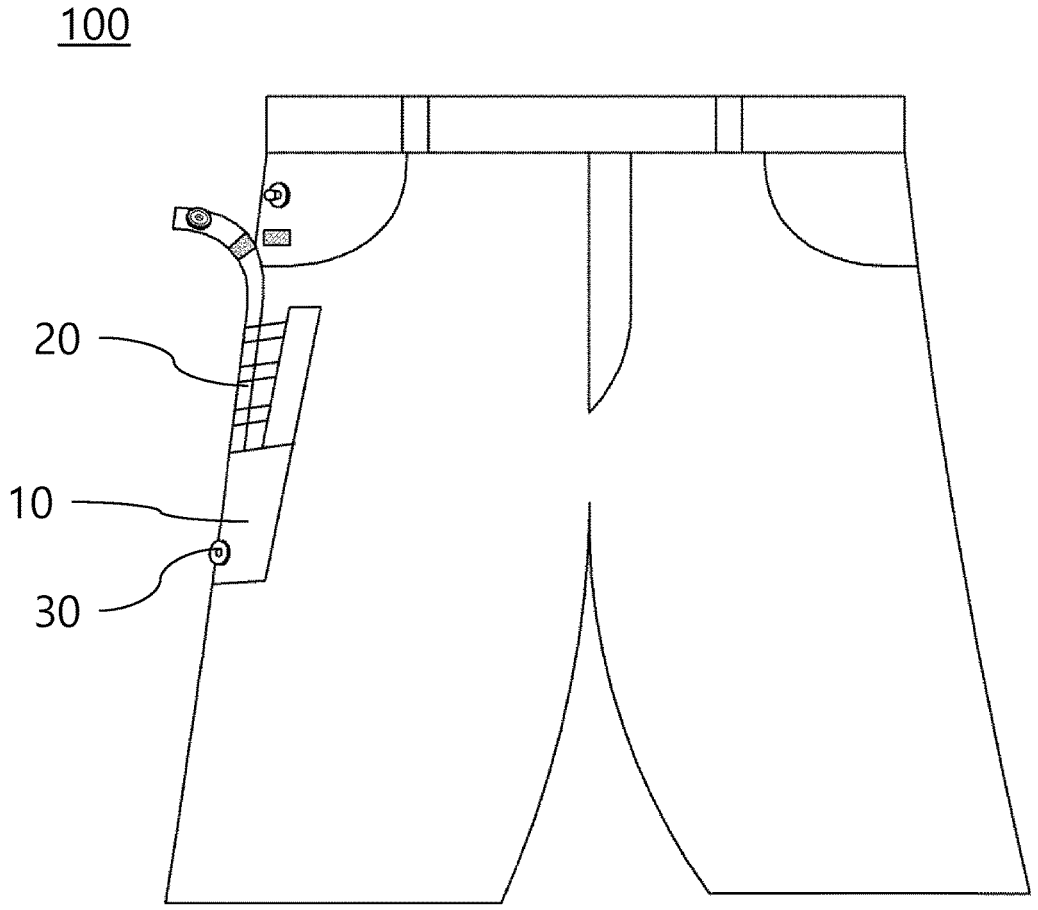
FIG. 2 shoves another view of the pocket according to one embodiment of the present invention.
Figure 3:
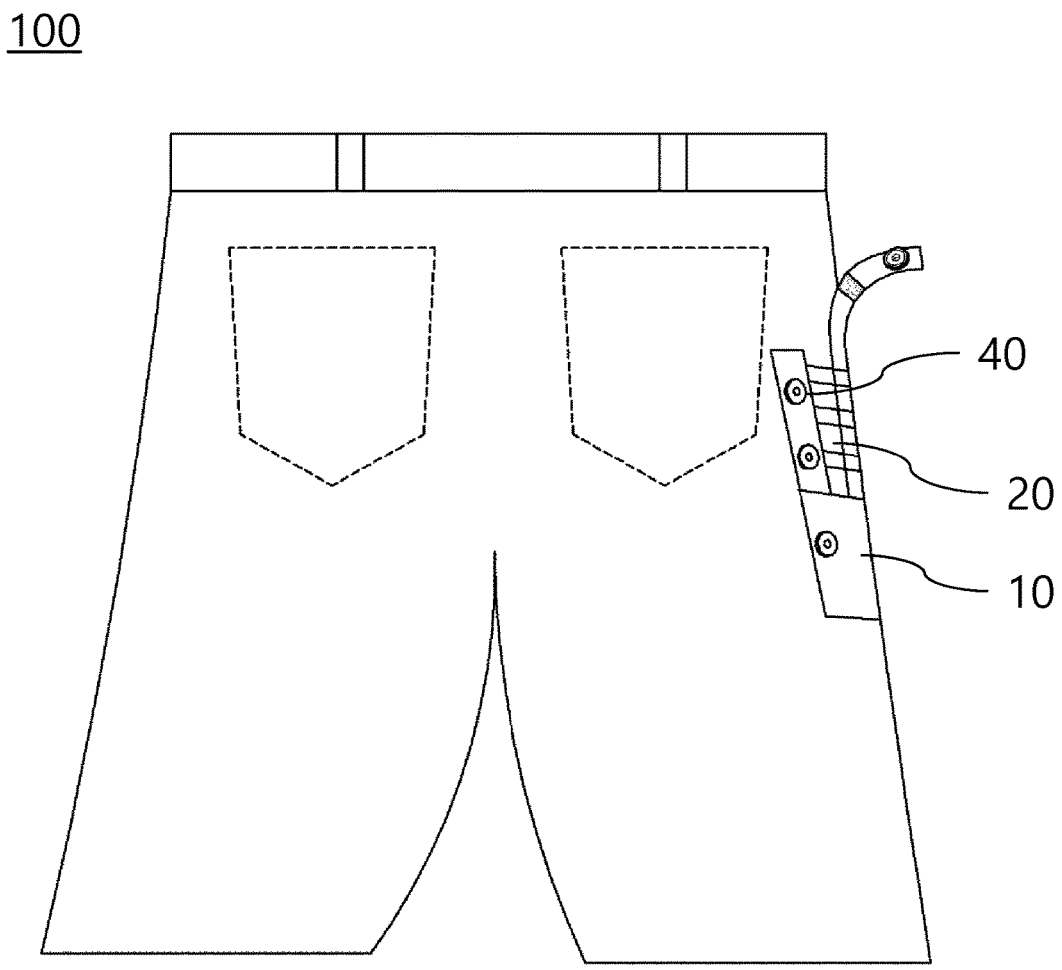
FIG. 3 shows still another view of the pocket according to one embodiment of the present invention.

FIG. 1 shows a front view of a pocket for a garment according to one embodiment of the present invention. FIG. 2 shows a front view of the pocket for a garment of FIG. 1 where the pocket is formed on the garment. FIG. 3 shows a rear view of the pocket for a garment of FIG. 1 where the pocket is fixedly formed on the garment.

The pocket 100 for a garment 80 for receiving a mobile electronic device therein includes a lower portion 10, fixedly attached to the garment 80 and an upper portion 20, fixedly attached to the garment 80 wherein the lower 10 and upper portions 20 form the pocket for receiving the mobile electronic device. The pocket 100 for a garment 80 further included a depth adjusting means 30 which is formed on the lower portion 10 and the garment 80 for vertically adjusting a pocket space and a width adjusting means 40 which is formed on the upper portion 20 and the garment 80 for horizontally adjusting the pocket space.

The upper portion 20 may comprise a first side strip 21, a second side strip 22, and an extendable strip 50, wherein the first and second side strips 22 are fixedly attached to the lower portion 10 on both sides of the lower portion 10 and the extendable strip 50 is connected to the first 21 and second side strips 22 as shown in FIG. 1.

The pocket 100 for a garment 80 further includes the width adjusting means 40 which is formed on the first side strip 21 and the garment 80. The width adjusting means 40 may be a snap fastener or a hook and loop fastener and the depth adjusting means 30 may be a snap fastener or a hook and loop fastener.

Using the width adjusting means 40 and the depth adjusting means 30, the space of the pocket 100 can be adjusted to receive various sizes of a mobile phone. For example, iPhone 6™ and iPhone 6 Plus™ have different sizes and the width adjusting means 40 and the depth adjusting means 30 can be constructed to receive both of iPhone 6™ and iPhone 6 Plus™.

The lower portion 10 of the pocket 100 may foe made of same fabric as the garment 80. The upper portion 20 of the pocket 100 may comprise a plurality of extendable strips 50 which is connected to the first and second side strips 21, 22. The upper portion 20 may further comprise a vertical strip 51 which is fixedly attached to the plurality of extendable strips 50. One end of the vertical strip 51 may be fixedly attached to the lower portion 10 and another end of the vertical strip 51 may be configured to be attachable to the garment 80 using an attachment means 52.

The attachment means 52 may be a snap fastener. The attachment means 52 may further include a first attachment means 53 and a second attachment means 54. The first attachment means 53 may be a hook and loop fasteners and the second attachment means 54 may be a snap fastener. The garment 80 may be pants, trousers, shorts or jeans.

Figure 4:
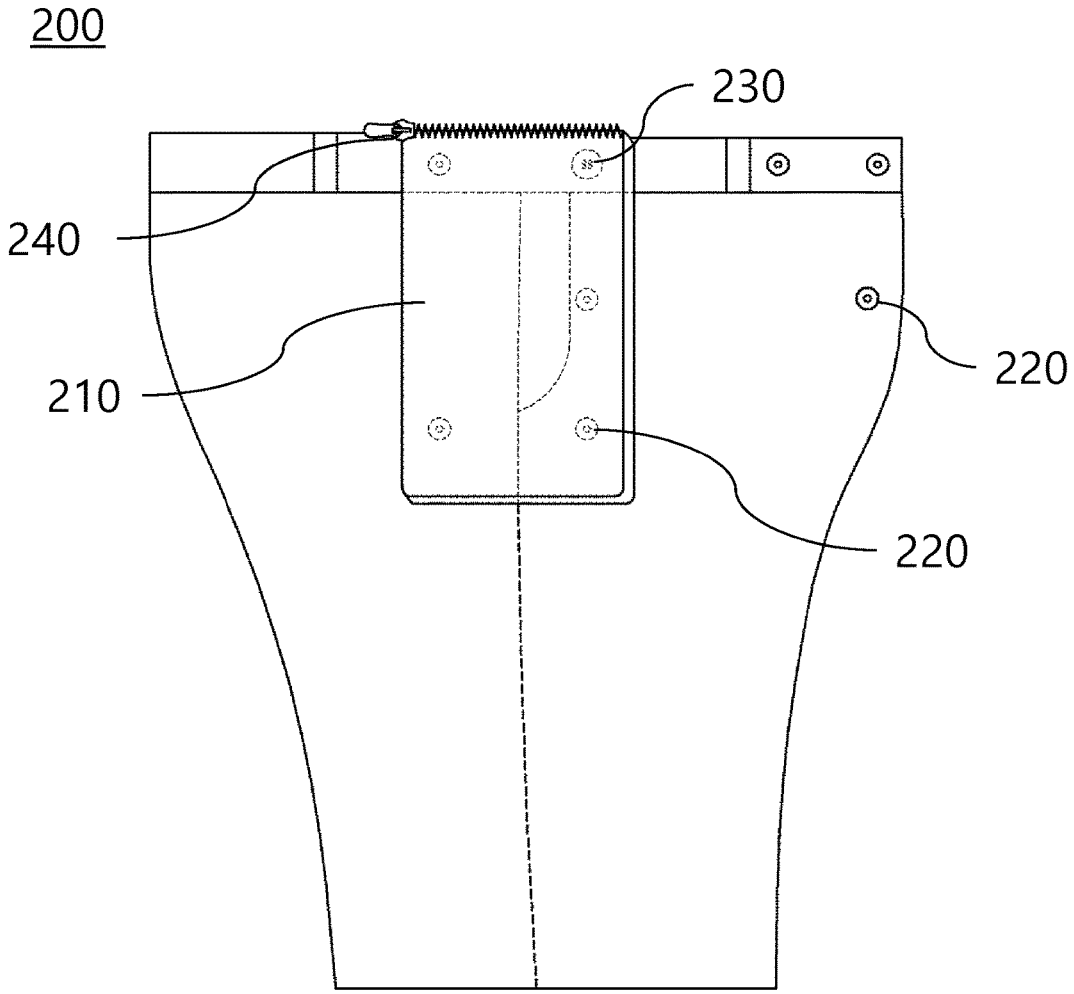
FIG. 4 shows a side view of a garment having a detachable pocket according to another embodiment of the present invention.
Figure 5:
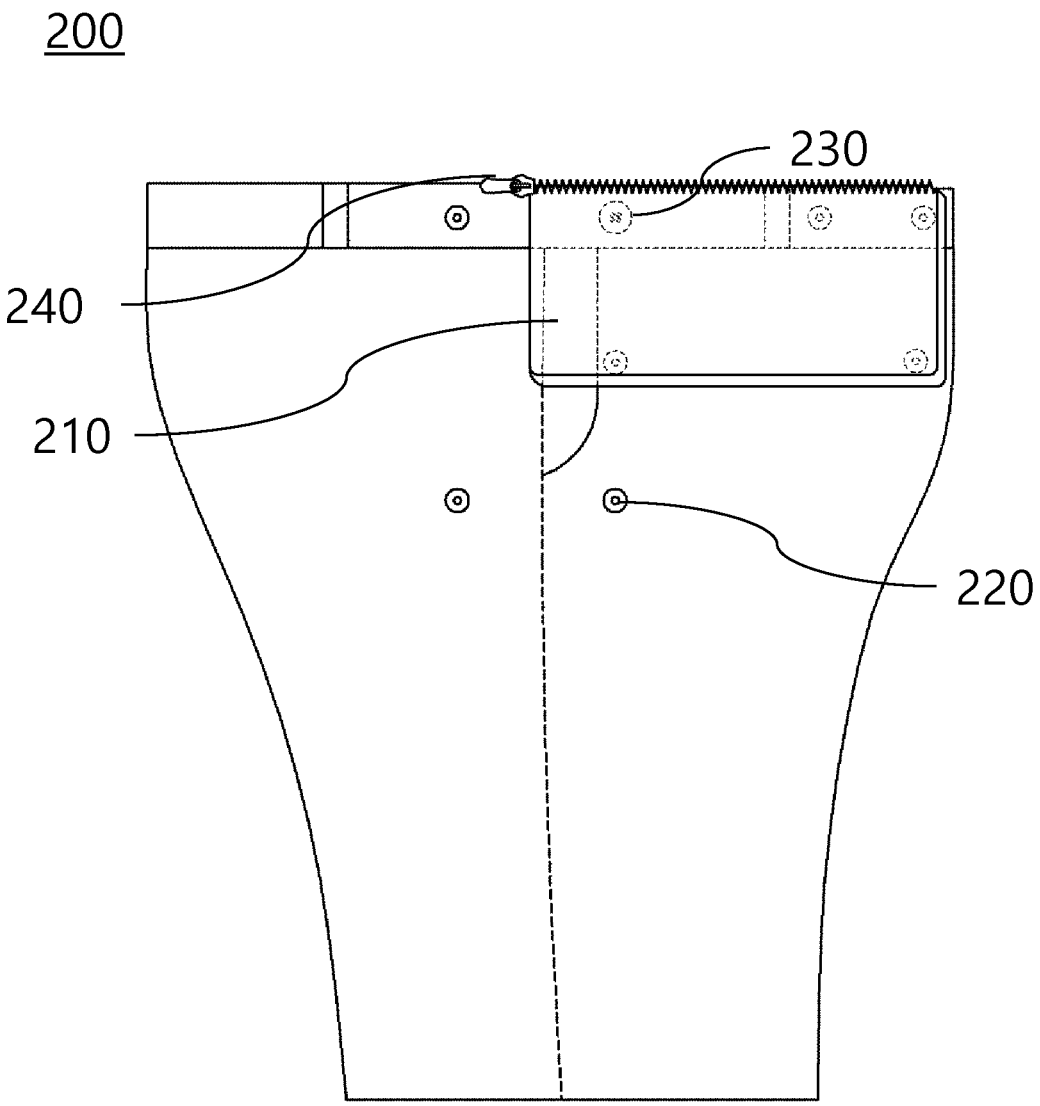
FIG. 5 shows another side view of a garment having a detachable pocket of FIG. 4, when the detachable pocket is rotated.
Figure 6:
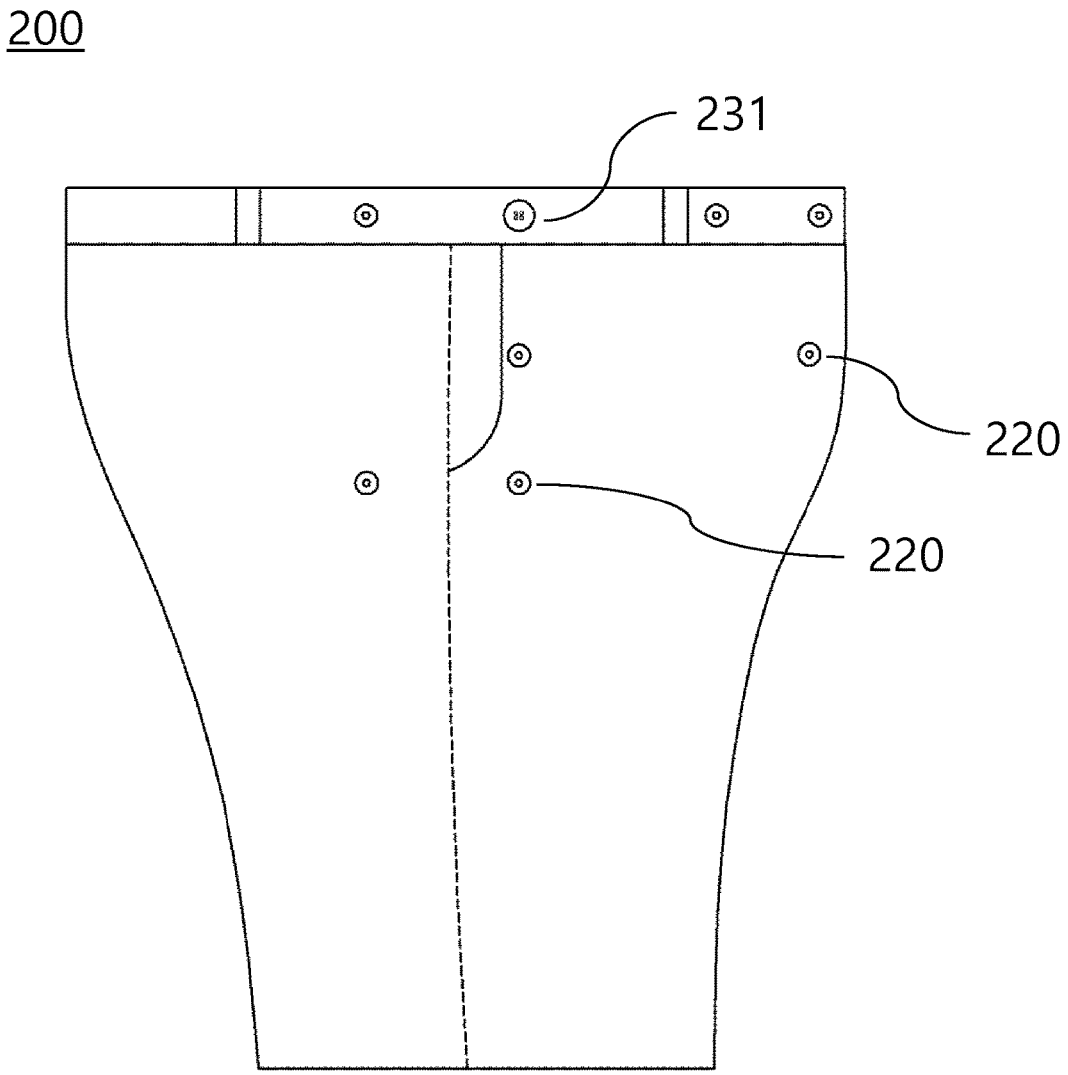
FIG. 6 shows another side view of a garment having a detachable pocket of FIG. 4, when the detachable pocket is detached from the garment.

FIG. 4 shows a side view of a garment having a detachable pocket according to another embodiment of the present invention. FIG. 5 shows a side view of a garment having a detachable pocket of FIG. 4. FIG. 6 shows a side view of a garment having a detachable pocket of FIG. 4, where the detachable pocket is detached from the garment.

Figure 7A:
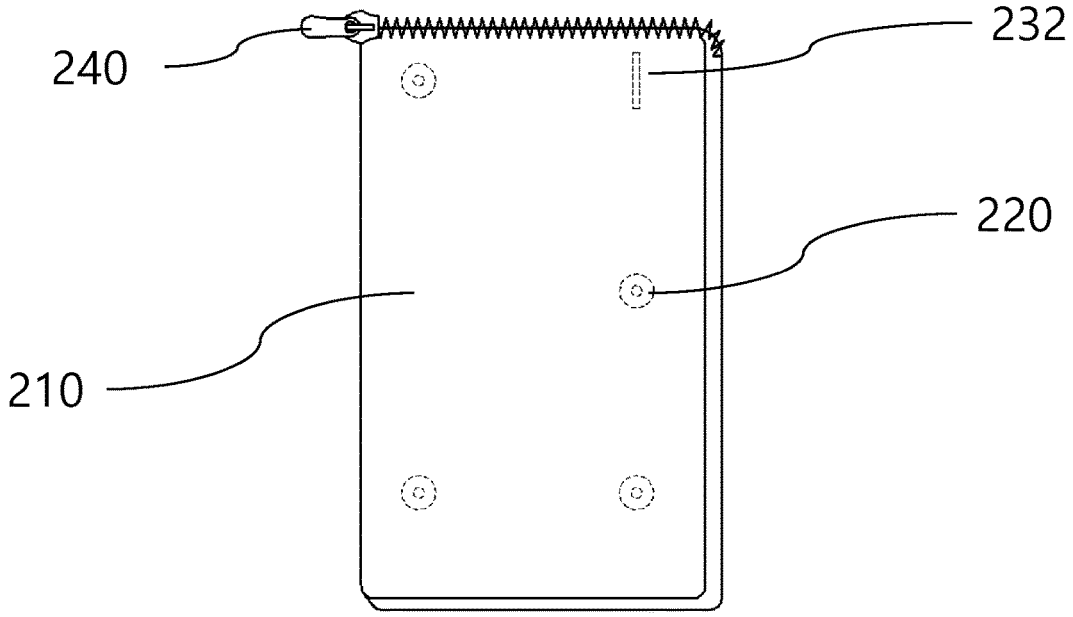
FIG. 7(*a*) shows a front view of the detachable pocket having an attachment means.
Figure 7B:
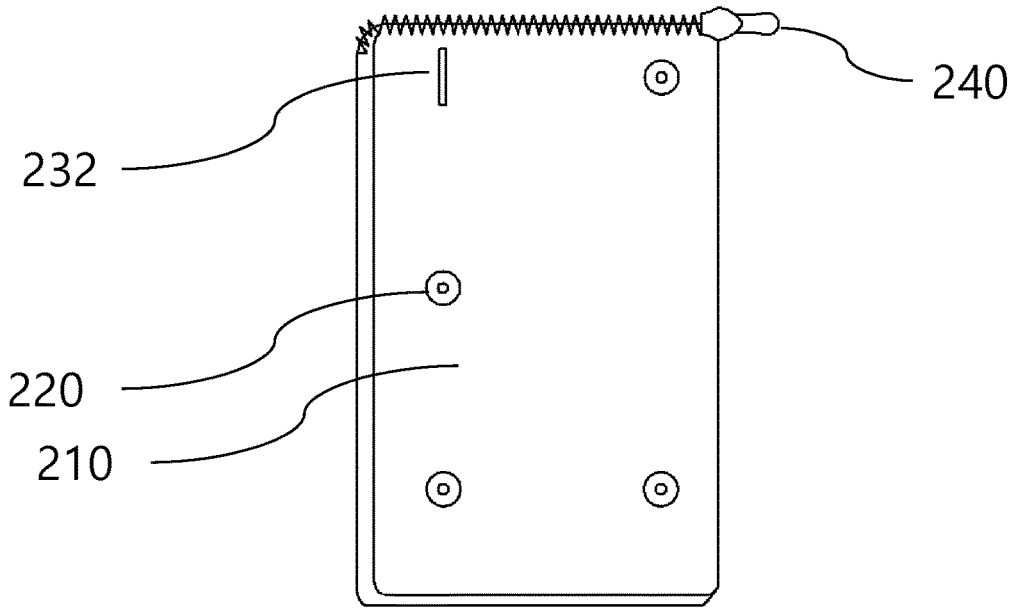
Figure 8A:
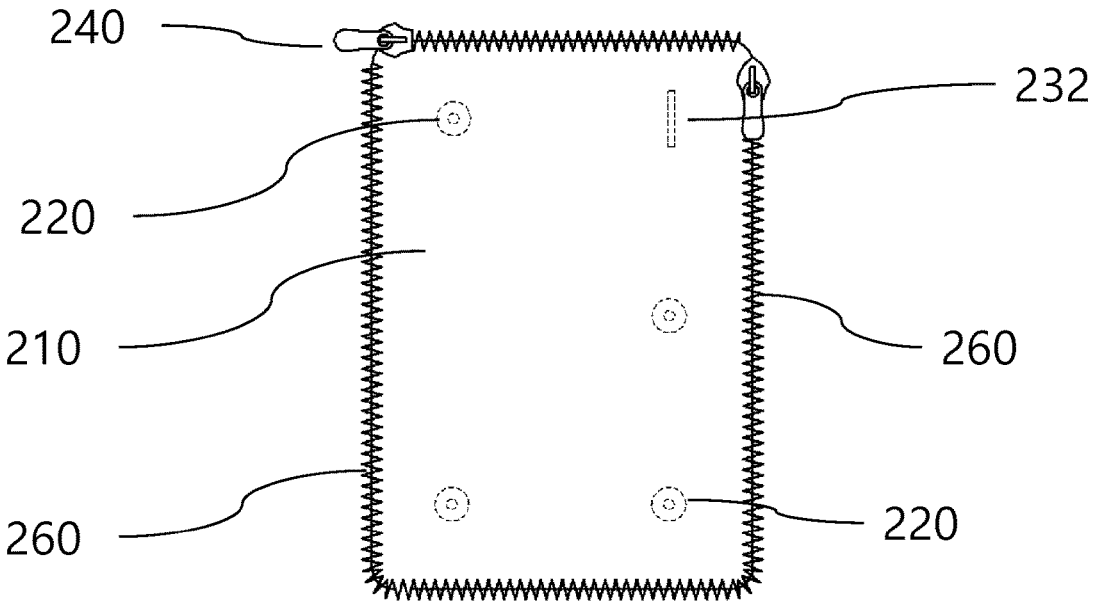
FIG. 8(*a*) shows a front view of the detachable pocket having a thickness adjusting means according to another embodiment of the present invention.
Figure 8B:
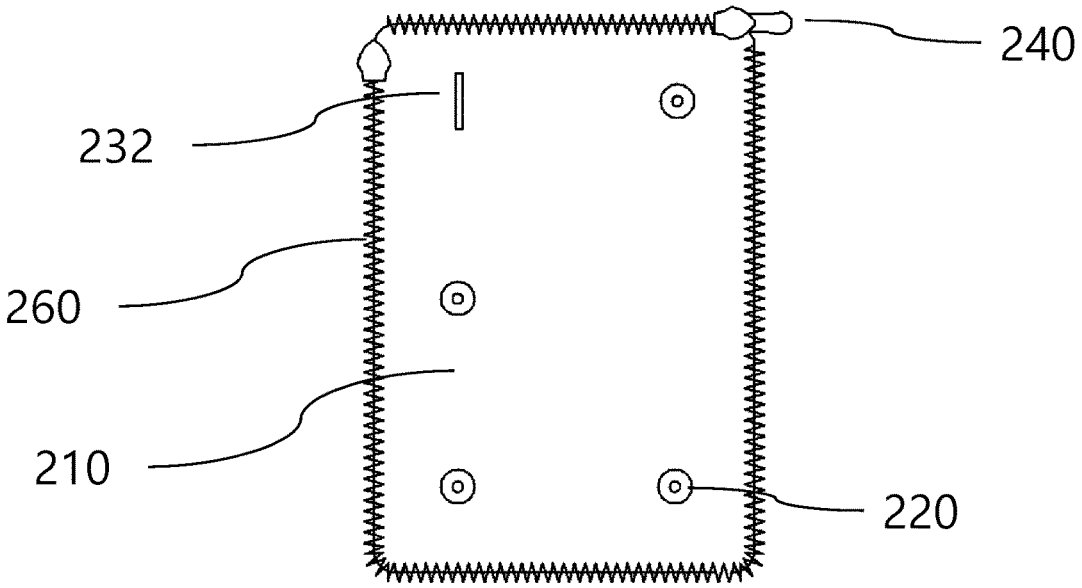

FIGS. 7(*a*) and 7(*b*) show a front and rear view of the detachable pocket having an attachment means. FIGS. 8(*a*) and 8(*b*) show a front and rear view of the detachable pocket which has a thickness adjusting means.

A garment 200 having a detachable pocket 210 includes an attachment means 220 for detachably attaching the detachable pocket 210 to the garment 200; and a rotating axis portion 210 wherein the detachable pocket 210 is constructed to rotate with respect to the rotating axis portion 230. The attachment means 220 is configured so that the detachable pocket 210 can be attachable to the garment 200 when the detachable pocket 210 is in a horizontal orientation and a vertical orientation. A closure means 240 to open or close the first opening.

The rotating axis portion 230 may comprise a button 231 attached to the garment 200 and a buttonhole 232 formed on the detachable pocket 210. The attachment means 220 may include a plurality of snap fasteners.

The detachable pocket 210 further includes a pocket thickness adjusting means 260, wherein the pocket thickness adjusting means 260 comprises a sipper fixedly formed on sides of the detachable pocket 210. By sipping or unzipping the zipper, the thickness of the pocket 210 can be adjusted.

Figure 9:
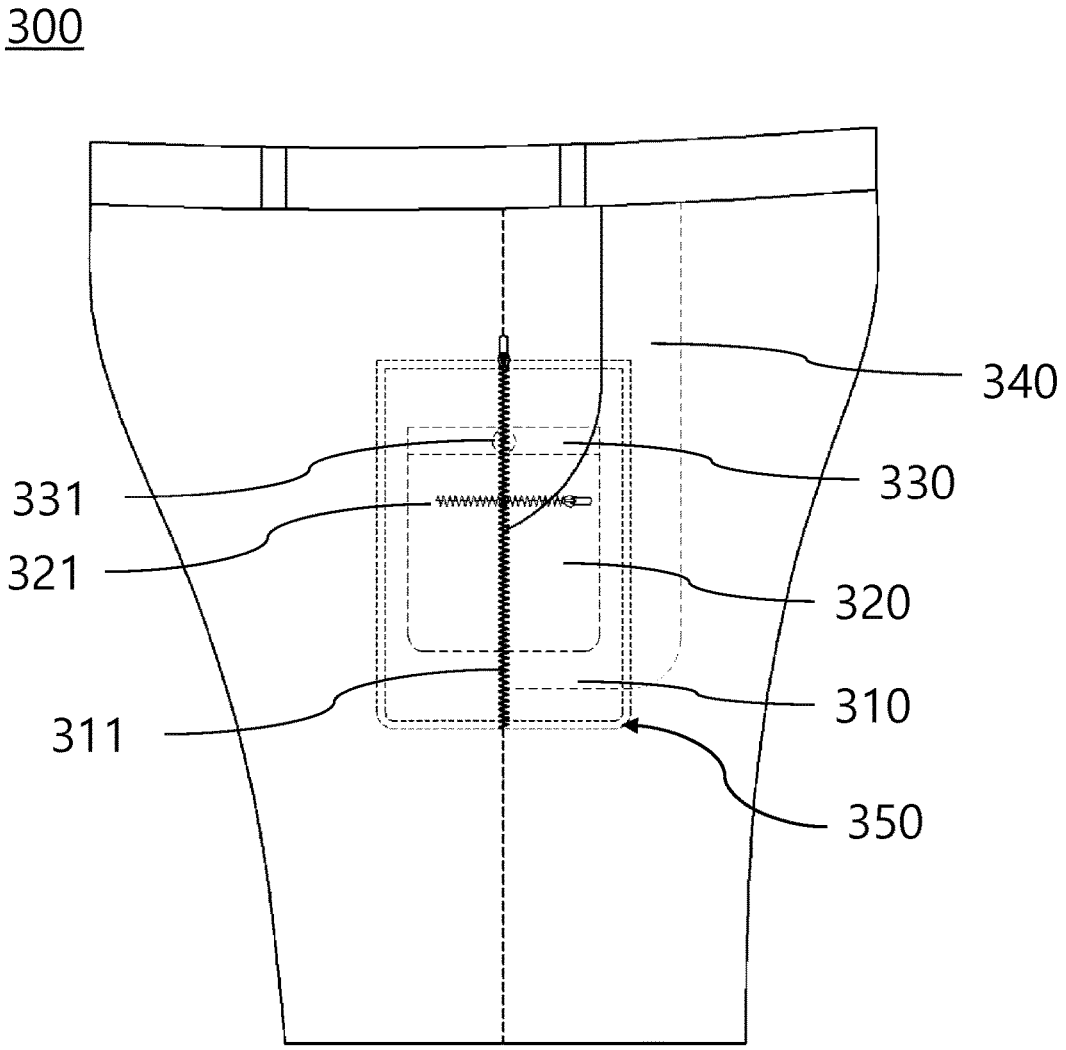
FIG. 9 shows a side view of a garment for a pocket according to still another embodiment of the present invention.
Figure 10:
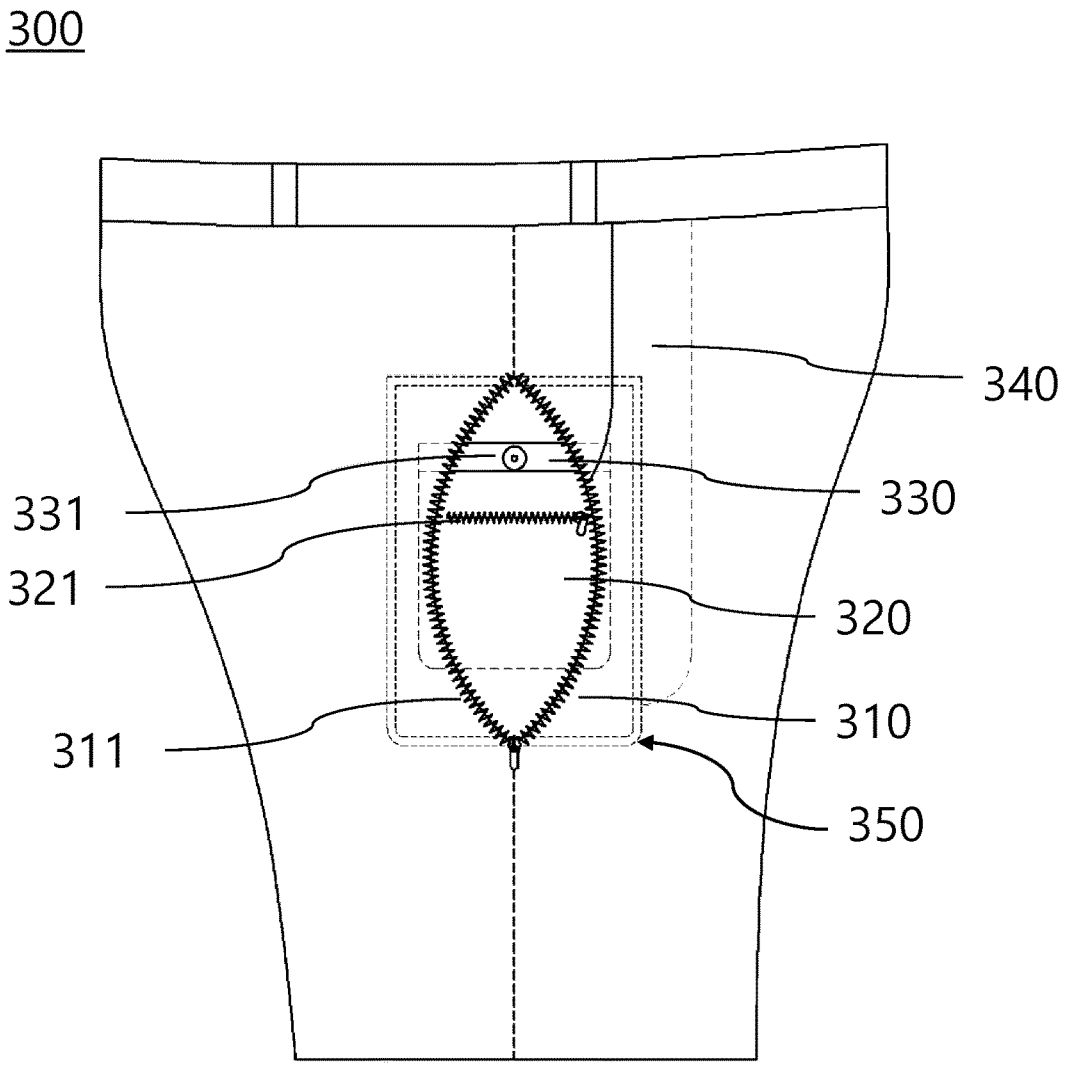
FIG. 10 shows a side view of a garment for a pocket of FIG. 9 when a first pocket is open.
Figure 11:
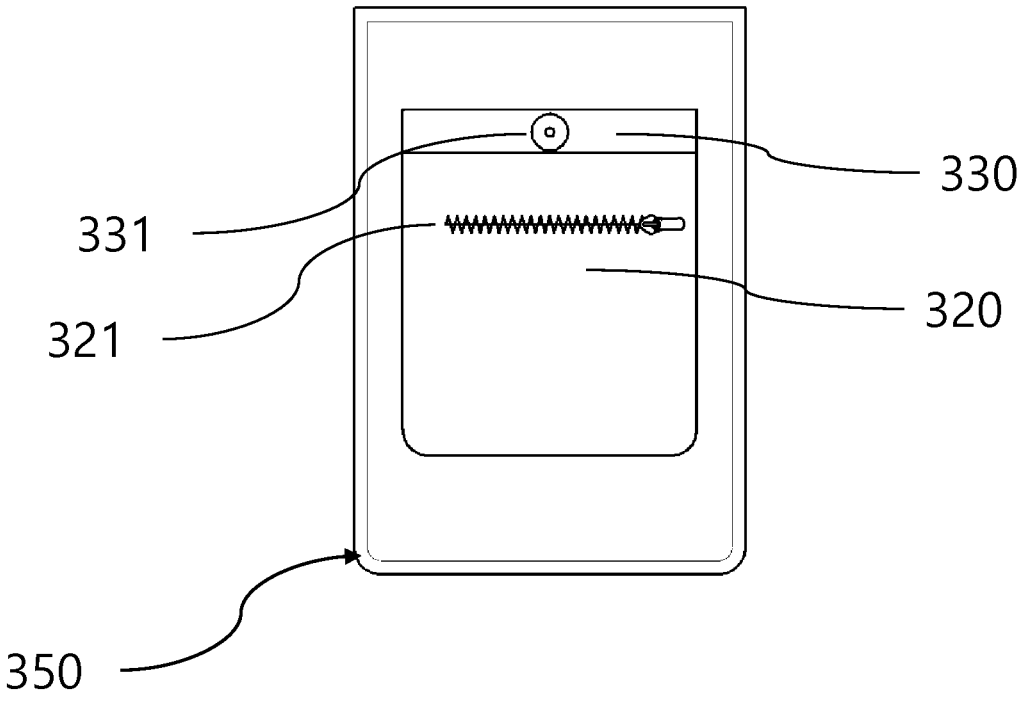
FIG. 11 shows a front view of a pocket of FIG. 9.

FIG. 9 shows a side view of a garment for a pocket according to still another embodiment of the present invention. FIG. 10 shows another side view of a garment for a pocket of FIG. 9 where a first pocket is open. FIG. 11 shows a front view of a pocket of FIG. 9.

A garment 300 for a pocket 350 includes a first pocket 310, fixedly attached to the garment 300 at a predetermined location, having a first opening wherein the first pocket is accessible through the first opening; a first closure means 311 to open or close the first opening; a second pocket 320, fixedly attached to the first pocket 310, having a second opening wherein the second pocket 320 is accessible through the first opening and the second opening; a second closure means 321 to open or close the second opening; and a side pocket 340 having a diagonal opening formed on the garment 300. The diagonal opening does not have a closure means. The first closure means 311 is formed substantially along a vertical side seam of the garment 300. The first opening meets an end of the diagonal opening or the first opening is formed in a vicinity of the end of the diagonal opening.

The garment 300 for a pocket of claim 18 may further comprise a third pocket 330, fixedly attached to the first pocket 310, having a third opening wherein the third pocket 330 is accessible through the first opening and the third opening.

The garment 300 may further include a third closure means 331 to open or close the third opening. The first closure means 311 may be a zipper, and the second 321 and third closure means 331 may be respectively a zipper and a snap fastener, or a snap fastener and a zipper.

Figure 12:
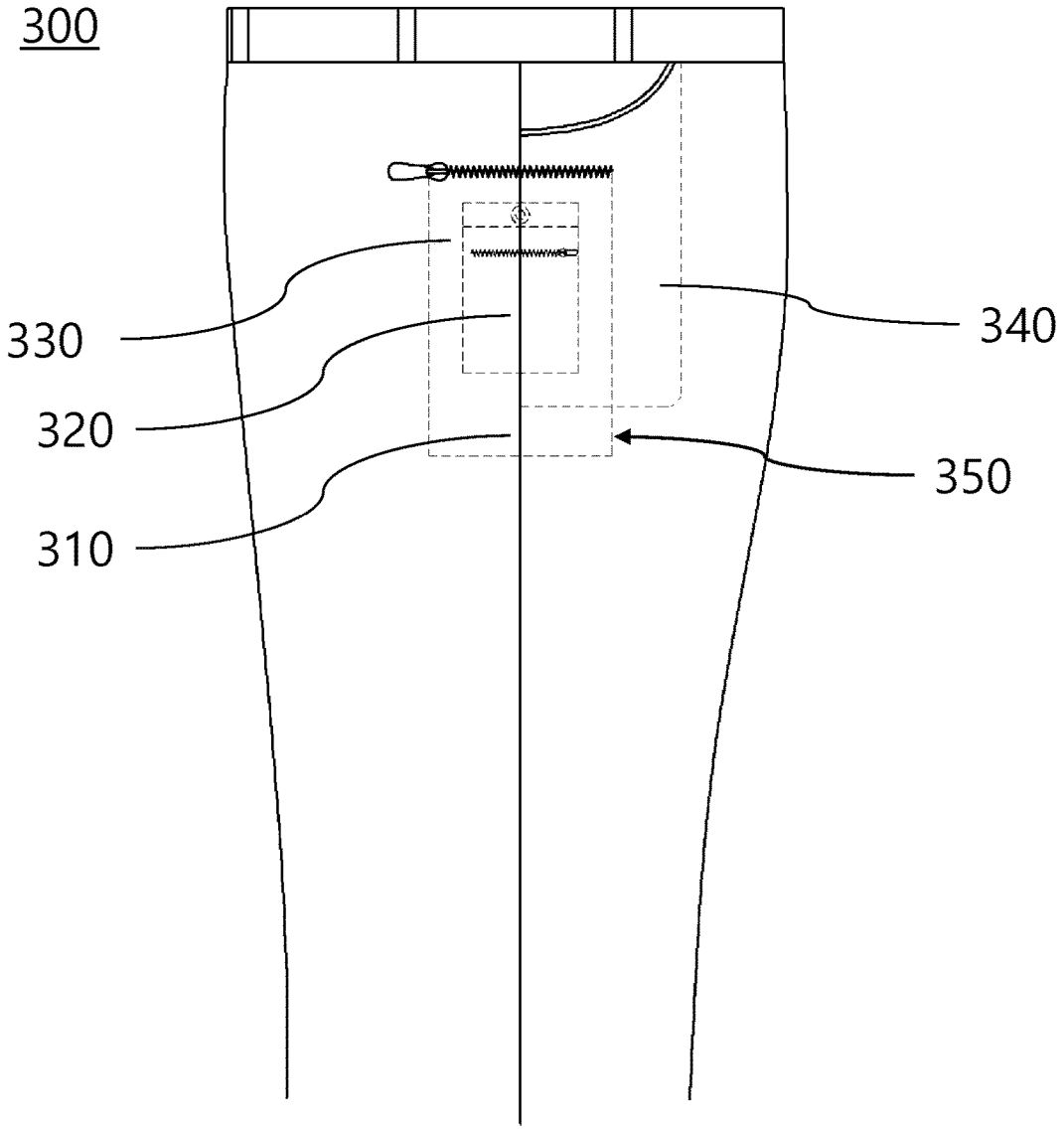
FIG. 12 shows a side view of a garment for a pocket of FIG. 9 according to still another embodiment of the present invention.

FIG. 12 shows a side view of a garment for a pocket of FIG. 9 where the first closure means is substantially perpendicular to the side seam of the garment according to still another embodiment of the present invention.

Figure 13:
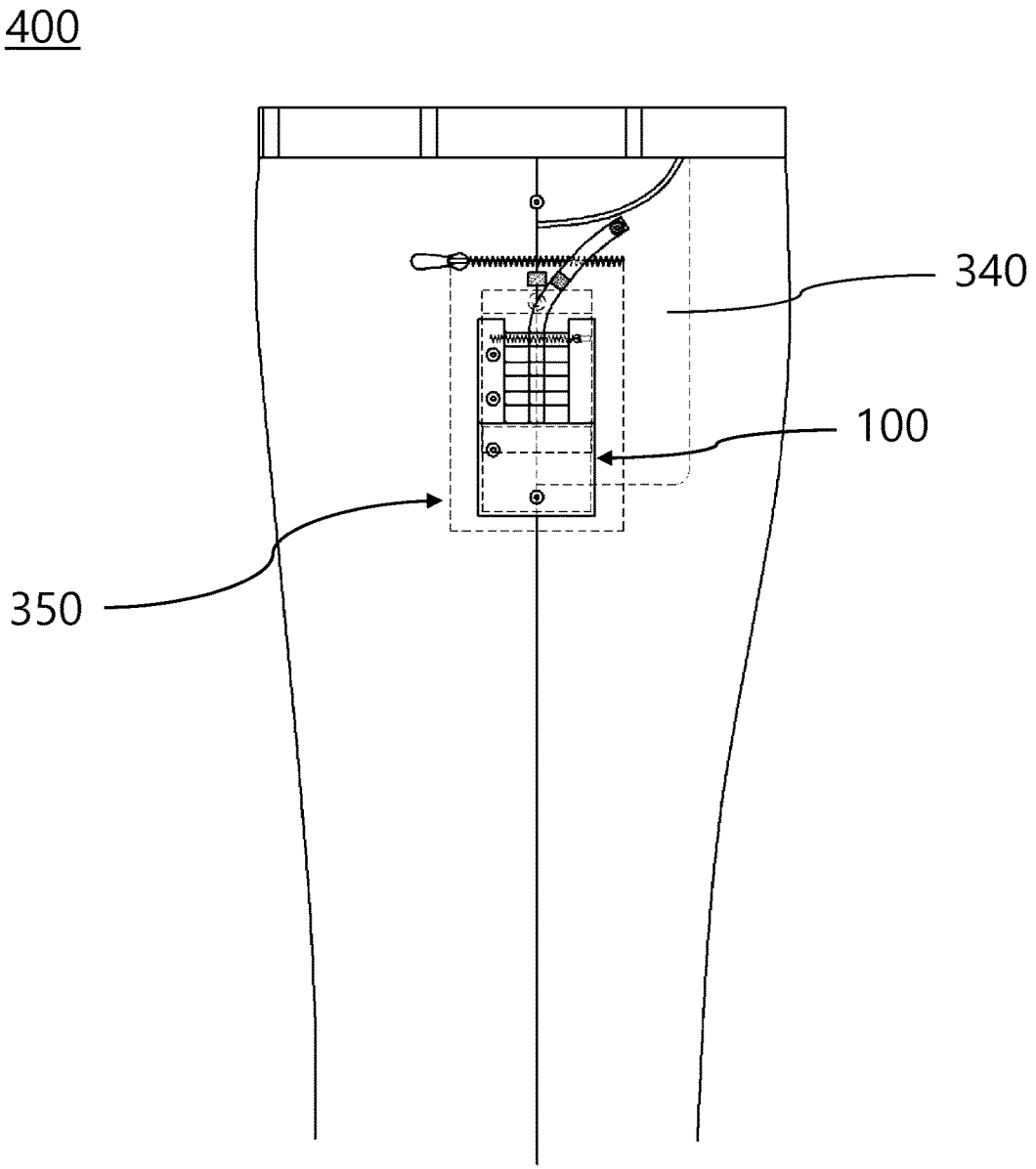
FIG. 13 shows a side view of a garment for a pocket according to still another embodiment of the present invention.

FIG. 13 shows a side view of a garment for a pocket according to still another embodiment of the present invention.

In this embodiment, pockets 350 are formed on the garment and another pocket 100 as disclosed in FIG. 1 is formed on the pockets 350.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A pocket for a garment for receiving a mobile electronic device therein, comprising:

a lower portion, fixedly attached to the garment; and an upper portion, fixedly attached to the garment;

wherein the lower and upper portions are sewn together to form the pocket for receiving the mobile electronic device, wherein a depth adjusting means is formed on the lower portion and the garment for vertically adjusting a pocket space, wherein a width adjusting means is formed on the upper portion and the garment for horizontally adjusting the pocket space.

2. The pocket of claim 1, wherein the upper portion comprises a first side strip, a second side strip, and an extendable strip, wherein the first and second side strips are fixedly attached to the lower portion on both sides of the lower portion and the extendable strip is connected to the first and second side strips.

3. The pocket of claim 2, wherein the width adjusting means is formed on the first side strip and the garment.

4. The pocket of claim 3, wherein the width adjusting means is a snap fastener or a hook and loop fastener.

5. The pocket of claim 2, wherein the depth adjusting means is a snap fastener or a hook and loop fastener.

6. The pocket of claim 1, wherein the lower portion of the pocket is made of same fabric as the garment.

7. The pocket for a garment of claim 2, wherein the upper portion of the pocket comprises a plurality of extendable strips which is connected to the first and second side strips.

8. The pocket for a garment of claim 7, wherein the upper portion comprises a vertical strip which is fixedly attached to the plurality of extendable strips.

9. The pocket for a garment of claim 8, wherein one end of the vertical strip is fixedly attached to the lower portion and another end of the vertical strip is configured to be attachable to the garment using an attachment means.

10. The pocket for a garment of claim 9, wherein the attachment means is a snap fastener.

11. The pocket for a garment of claim 9, wherein the attachment means comprises a first attachment means and a second attachment means.

12. The pocket for a garment of claim 9, wherein the first attachment means is a hook and loop fasteners and the second attachment means is a snap fastener.

13. The pocket for a garment of claim 1, wherein the garment is pants, trousers, shorts or jeans.

14. A garment having a detachable pocket, comprising:

an attachment means for detachably attaching the detachable pocket to the garment; and a rotating axis portion comprising a button attached to the garment and a buttonhole formed on the detachable pocket wherein the buttonhole corresponds to the button, wherein the detachable pocket is constructed to rotate with respect to the rotating axis portion, and wherein the attachment means is configured so that the detachable pocket can be attachable to the garment when the detachable pocket is in a horizontal orientation and a vertical orientation.

15. The garment of claim 14, wherein the rotating axis portion comprises a button attached to the garment and a buttonhole formed on the detachable pocket.

16. The garment of claim 14, wherein attachment means comprises a plurality of snap fasteners.

17. The garment of claim 14, wherein the detachable pocket further comprises a pocket thickness adjusting means, wherein the pocket thickness adjusting means comprises a zipper fixedly formed on sides of the pocket.

18. A garment for a pocket, comprising:

a first pocket, fixedly attached, to the garment at a predetermined location, having a first opening wherein the first pocket is accessible through the first opening;

a first closure means to open or close the first opening, a second pocket, fixedly attached to the first pocket, having a second opening wherein the second pocket is accessible through the first opening and the second opening;

a second closure means to open or close the second opening; and a side pocket having a diagonal opening formed on the garment, wherein the diagonal opening does not have a closure means and wherein the diagonal opening has an upper end and a lower end, wherein the first closure means is formed substantially along a vertical side seam of the garment, wherein the first opening overlays the lower end of the diagonal opening or the first opening is formed in a vicinity of the end of the diagonal opening.

19. The garment for a pocket of claim 18, further comprising a third pocket, fixedly attached to the first pocket, having a third opening wherein the third pocket is accessible through the first opening and the third opening, wherein the garment further comprises a third closure means to open or close the third opening.

20. The garment for a pocket of claim 19, wherein the first closure means is a zipper, and the second and third closure means are a zipper and a snap fastener, or a snap fastener and a zipper.

* * * * *